US007445062B2

(12) United States Patent
Thuresson et al.

(10) Patent No.: US 7,445,062 B2
(45) Date of Patent: Nov. 4, 2008

(54) GREASE FILLING ARRANGEMENT IN A CUTTER FOR A BORING HEAD

(75) Inventors: Jonas Thuresson, Fagersta (SE); Lars Holmgren, Sala (SE)

(73) Assignee: Atalas Copco Secoroc AB, Fagersta (SE)

( * ) Notice: Subject to any disclaimer, the term of this patent is extended or adjusted under 35 U.S.C. 154(b) by 0 days.

(21) Appl. No.: 11/855,688

(22) Filed: Sep. 14, 2007

(65) Prior Publication Data

US 2008/0000695 A1 Jan. 3, 2008

Related U.S. Application Data

(62) Division of application No. 10/508,246, filed as application No. PCT/SE03/00433 on Mar. 14, 2003, now abandoned.

(30) Foreign Application Priority Data

Mar. 20, 2002 (SE) ..... 0200875

(51) Int. Cl.
*E21B 10/24* (2006.01)

(52) U.S. Cl. ..... 175/227; 175/344

(58) Field of Classification Search ..... 175/227, 175/228, 299, 229, 344
See application file for complete search history.

(56) References Cited

U.S. PATENT DOCUMENTS 2,814,465 A 11/1957 Green
2,906,504 A 9/1959 Parks
3,193,028 A 7/1965 Radzimovsky
3,244,459 A 4/1966 Ortloff
3,413,045 A 11/1968 Wohfeld
3,419,093 A 12/1968 Lichte et al.
4,228,863 A * 10/1980 Liljekvist et al. ..... 175/344
4,709,462 A * 12/1987 Perkin et al. ..... 29/434
5,137,097 A 8/1992 Fernandez
5,520,257 A 5/1996 Crewa

FOREIGN PATENT DOCUMENTS

| | | |
|---|---|---|
| RU | 2082868 | 6/1997 |
| SU | 926222 | 5/1955 |
| WO | 96/25581 | 8/1996 |

* cited by examiner

*Primary Examiner*—Jennifer H Gay
*Assistant Examiner*—David Andrews
(74) *Attorney, Agent, or Firm*—Young & Thompson

(57) ABSTRACT

An arrangement for replenishing lubricating grease in drill cutters (3) that include a conical outer barrel (7) which is rotatable about a shaft (5) disposed centrally in the cutter, wherein there is provided in the cutter shaft (5) a passageway (16) that extends along the shaft from the cutter end of largest diameter and that connects with a transverse passageway (18) which opens into a bearing-accommodating space (13) in the cutter for delivering lubricating grease to the space (13), and wherein a lubricating nipple (19) is provided on the cutter end wall of largest diameter and functions to allow lubricating grease to be released from the bearing-accommodating space (13).

7 Claims, 2 Drawing Sheets

GREASE FILLING ARRANGEMENT IN A CUTTER FOR A BORING HEAD

FIELD OF THE INVENTION

The present invention relates to an arrangement pertaining to the replenishment of drill cutters with lubricating grease, and then particularly such cutters as those that are used in drilling bits for raise drilling.

BACKGROUND OF THE INVENTION

A reamer is a drill bit that is normally drawn up through a predrilled hole by means of a rod extending in the hole. The reamer includes a carrier to whose upper side there is attached a drilling tool in the form of a number of so-called cutters. These cutters rotate against the rock surface, or stone surface, with which they are in abutment, as the reamer rotates in response to rotation of the rod. The cutters have a frusto-conical shape and are mounted with the largest diameter facing outwards, i.e. away from the rod disposed centrally in said carrier. The cutters are mounted on shafts accommodated in the attachments carried on the upper side of the carrier, with the axes of respective cutters extending mainly radially to the rod.

In turn, the cutters are provided with bearings by means of which the cutters are able to rotate about their respective axes. These bearings and also the seals between cutter and cutter shaft are kept lubricated with grease fed into the cutter interior. A shaft is usually filled with lubricating grease, by injecting the grease through a nipple at one end of the shaft and allowing the grease to flow out through a nipple hole on the other end of said shaft. This method functions very effectively provided that the cutter is not mounted within the reamer. However, when it becomes necessary to replenish or change the grease, which must done often when underground conditions are troublesome, it is difficult to reach the nipple seated at the narrower end of the cutter facing inwards towards the rod.

OBJECT OF THE INVENTION

Accordingly, an object of the present invention is to provide a novel arrangement for refilling drill hole cutters of the aforesaid kind with lubricating grease.

SUMMARY OF THE INVENTION

This object is achieved with an arrangement according to the present invention in which there is provided a passageway which extends along the shaft from the cutter end of largest diameter and which communicates with a transverse passageway that opens into the space accommodating a cutter bearing, for the supply of lubricating grease to said space, and in which there is provided in the cutter wall of largest diameter a lubricating nipple that functions to allow lubricating grease to exit from said bearing accommodating space.

BRIEF DESCRIPTION OF THE DRAWINGS

The invention will now be described in more detail with reference to a non-limiting embodiment thereof and also with reference to the accompanying drawings, in which.

DETAILED DESCRIPTION OF THE INVENTION

Figure 1:
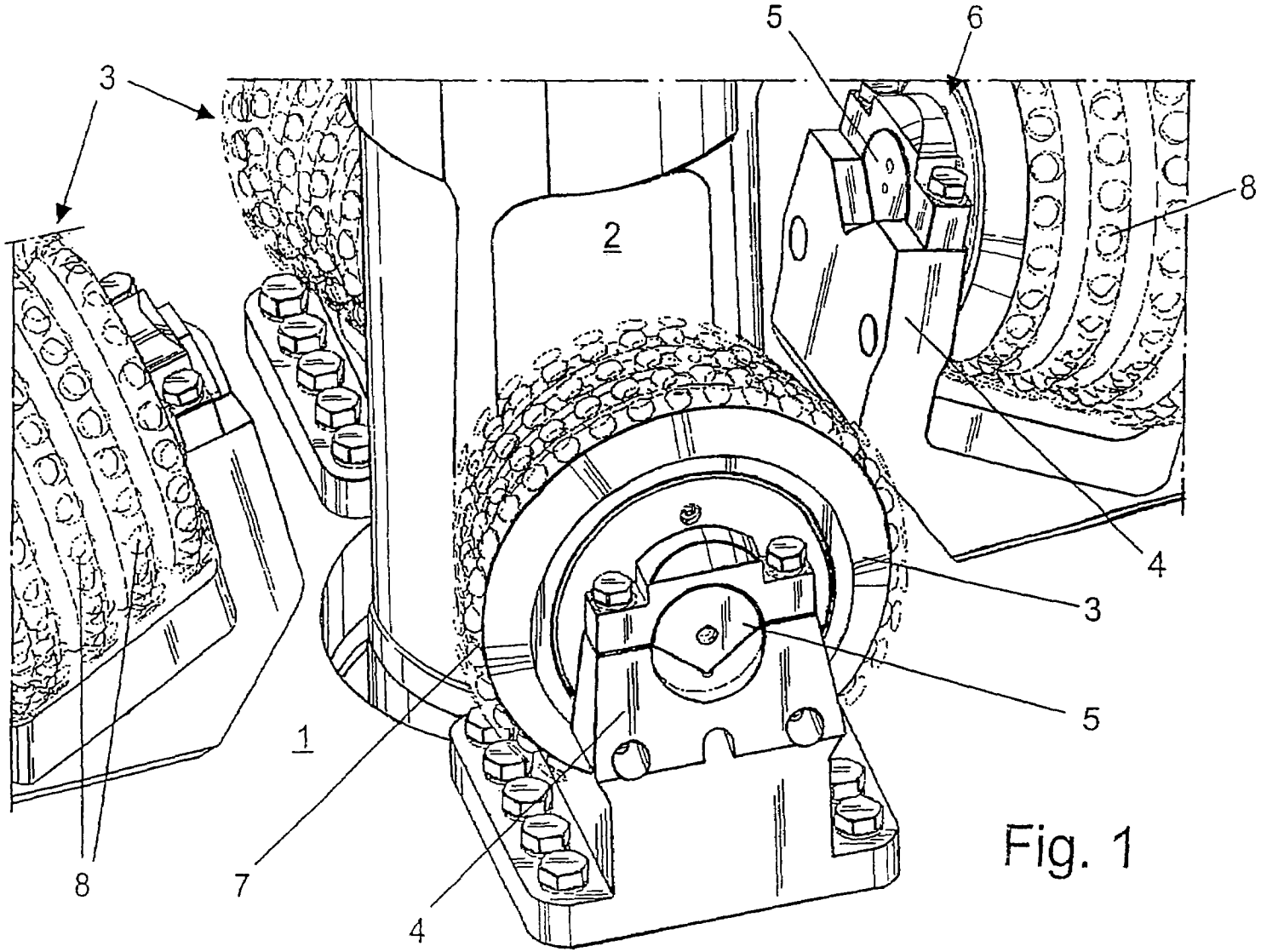
FIG. 1 is a schematic perspective view of part of a reamer having a number of cutters.
Figure 2:
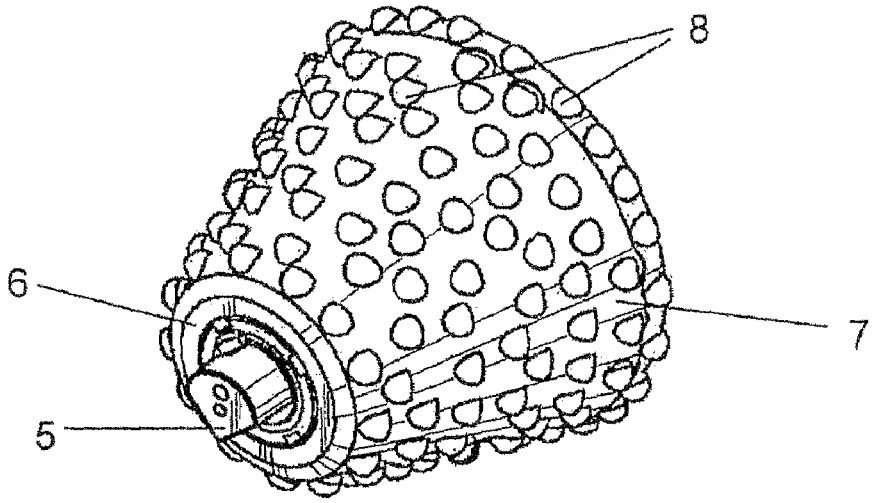
FIG. 2 is a perspective view of a cutter.

Shown in FIG. 1 is part of a reamer that includes a carrier 1 which is supported by a rotatable rod 2. The carrier 1 has disposed on its upper side a number of cutters 3, in the illustrated case four such cutters. The cutters 3 are mounted in fasteners 4 provided on the carrier, with the cutter shafts 5 fitted in the fasteners 4. As will be seen, the cutters 3 have a frusto-conical shape with the narrower end 6 of the cutters facing inwards towards the rod 2 mounted centrally in the carrier 1. The cutter shafts 5 are fixedly mounted in the fasteners. In other words, the cutter shafts 5 are not rotatable in the fasteners 4, but that the conical outer barrel 7 of the cutters 3 is able to rotate about the shaft 5 disposed centrally in the cutter. The cutter has disposed about its outer barrel surface a number of inserts 8 made, for instance, of tungsten carbide and functioning to cut the rock or stone in a drilling operation.

The outer barrel 7 of respective cutters 3 is subjected to large stresses and strains and is rotatably mounted on the shaft 5 by means of strong bearings 9, 10. Fitted to both end walls of the barrel 7 are wall elements 11, 12 which seal between the barrel 7 and the shaft 5. There is formed in this way an internally closed space 13 which accommodates the bearings 9, 10 and also end seals 14, 15. The internal space 13 is normally filled with grease for lubrication of the bearings 9, 10. The wall elements 11, 12 are sealed against the barrel 7 and the shaft 5 by means of end seals 14, 15 that include slip seals and O-rings.

According to the present invention, lubricating grease is delivered to the bearing accommodating space 13 of the cutter through a longitudinally extending passageway 16, which extends centrally in the shaft 5 from that end of the cutter which has the largest diameter. A filling nipple 17 is provided at this end of the shaft, such as to enable grease to be delivered to said bearing space with the aid of a typical grease gun. The passageway 16 extends from said cutter end to a position beyond the innermost bearing 9 as seen from said end. The passageway 16 communicates at this position with a transverse passageway 18 which opens into the bearing-accommodating space 13 beyond the innermost bearing 9. Also provided in the end wall 12 of the cutter is a drainage nipple 19 through which old lubricating grease can be drained from the cutter interior when replacing the old grease with fresh grease. The same end wall 12 will also preferably include an overpressure valve 20 which opens automatically should the pressure in the internal space 13 of the cutter become excessively high, therewith releasing grease from said space.

Figure 3:
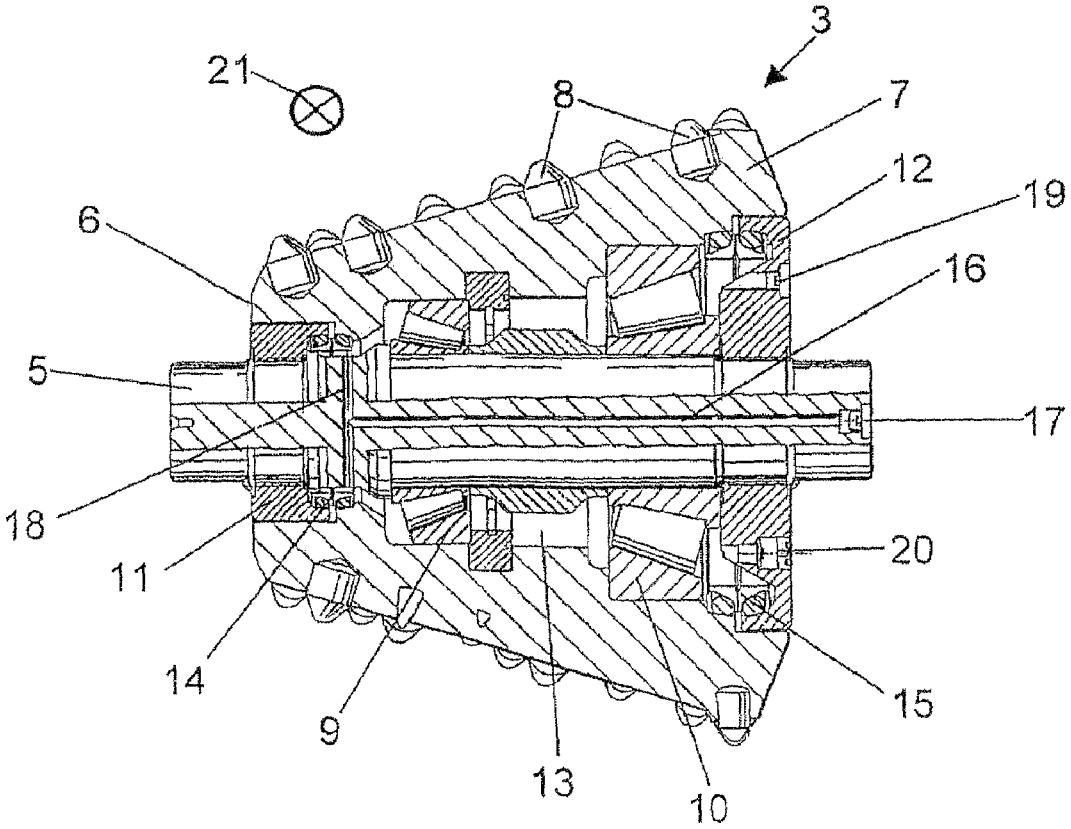
FIG. 3 is a longitudinally sectioned view of a cutter.

The transverse passageway 18 is preferably provided in a stress-neutral region of the shaft, particularly so that the outlet of the transverse passageway 18 into the cutter lies in a stress-neutral region. The force arrow 21 shown in FIG. 3 indicates the normal force flow, wherewith the transverse passageway 18 is disposed generally at right angles to the line of action of the main force.

In the case of the illustrated embodiment, the transverse passageway 18 extends at right angles in both directions from the passageway 16 provided in the shaft 5. This is a preferred feature of the invention, since it is then possible to deliver grease to two diametrically located positions of the shaft 5 within the inner space 13 of the cutter, therewith ensuring more positively that the entire space 13 will be filled with grease.

However, the transverse passageway may extend in only one direction essentially radially outwards from the longitudinally extending passageway 16. Alternatively, the transverse passageway may be orientated to extend generally at right angles to the line of attack of the main force.

In practice, the transverse passageway 18 is orientated so that it will lie generally horizontal when the cutter is fitted in its position of use on a reamer. As the reamer is used, the direction of attack of the main force will be generally vertical, since the reamer is drawn up through a predrilled vertical hole or bore.

The arrangement of the lubricating passageways 16, 18 in accordance with the invention ensures that all bearings in the cutter 3 will be properly lubricated, so as to avoid damage to the bearings, despite the fact that lubricating grease is delivered from the same end as that from which old and spent grease shall flow out. Despite this, the bearing-grease replenishing nipple 17 may be provided in the larger end wall of the cutter distal from the rod seated centrally in the reamer, so that easy access can be had to both the refilling nipple 17 and the drainage nipple 19.

The invention claimed is:

1. A reamer that includes a carrier (1) which is supported by a rotatable centrally mounted rod (2), the carrier having disposed thereon a plurality of cutters (3), the cutters being mounted in fasteners (4) on the carrier with cutter shafts (5) supported at opposite ends in the fasteners, the cutters having a frustoconical shape with a narrower end of the cutters facing inward toward the centrally mounted rod in the carrier, the cutters each including a conical outer barrel (7), a filling lubricating nipple (17) provided in each cutter shaft (5) on the cutter end wall of larger diameter and opening into a passageway (16) that extends longitudinally in the cutter shaft and that connects with a transverse passageway (18) which opens out into a bearing-accommodating space (13) in each cutter, for delivering lubricating grease to said bearing-accommodating space at a position beyond the innermost bearing (9), nearest said rod, of bearings (9, 10) disposed between the outer barrel of each cutter and the shaft of each cutter as seen from the cutter end of largest diameter, and another lubricating nipple (19) provided on the same cutter end wall as said filling lubricating nipple (17) and functioning to allow lubricating grease to be released from said bearing-accommodating space (13).

2. The reamer according to claim 1, wherein the longitudinally extending passageway (16) is disposed centrally in the cutter shaft (5).

3. The reamer according to claim 2, wherein the transverse passageway is located in a stress-neutral region of the cutter shaft (5).

4. The reamer according to claim 1, wherein the transverse passageway is located in a stress-neutral region of the cutter shaft (5).

5. The reamer according to claim 4, wherein the transverse passageway (18) is orientated generally horizontally when the cutter is mounted on a reamer in its position of use.

6. The reamer according to claim 1, wherein the transverse passageway (18) extends generally radially out from the longitudinally extending passageway (16).

7. The reamer according to claim 1, wherein the transverse passageway (18) extends out in generally opposite directions from the longitudinally extending passageway (16) and opens out at two diametrically opposite places on the shaft (5).

* * * * *